United States Patent [19]

Armstrong

[11] Patent Number: 5,060,854

[45] Date of Patent: Oct. 29, 1991

[54] REMOTE MAIL INDICATOR SYSTEM

[76] Inventor: Hugh Armstrong, 1650 Shamrock St., Milton, Fla. 32570

[21] Appl. No.: 703,874

[22] Filed: May 22, 1991

[51] Int. Cl.[5] ..... B65D 91/00

[52] U.S. Cl. ..... 232/37; 250/214 AL

[58] Field of Search ..... 232/34, 37; 340/569, 340/570; 250/214 AL, 222.1

[56] References Cited

U.S. PATENT DOCUMENTS

| | | | |
|---|---|---|---|
| 2,968,804 | 1/1961 | Buffington | 340/569 |
| 3,909,819 | 9/1975 | Radford | 340/569 |
| 4,268,823 | 5/1981 | Rauchut et al. | 340/570 |
| 4,314,102 | 2/1982 | Lowe et al. | 340/569 |
| 4,520,350 | 5/1985 | Huang | 232/37 |
| 4,633,236 | 12/1986 | Buhl | 232/37 |
| 4,659,919 | 4/1987 | Price | 340/555 |
| 4,794,377 | 12/1988 | Benages | 232/37 |
| 4,833,368 | 5/1989 | Lin | 250/214 AL |
| 4,872,210 | 10/1989 | Benages | 340/569 |
| 4,982,176 | 1/1991 | Schwarz | 250/214 AL |

*Primary Examiner*—Gary L. Smith
*Assistant Examiner*—Michael J. Milano
*Attorney, Agent, or Firm*—Kelly O. Corley

[57] ABSTRACT

A remote indicator system for determining at a remote location when incoming mail is present in a mailbox. A light port in the mailbox admits outside ambient light onto a first photodetector on the bottom of the mailbox. When no mail is present, the first photodetector produces a first signal indicating that no mail is present. When incoming mail is present, the light to the first photodetector is interrupted, causing the first photodetector to produce a second signal, indicating that mail is present. A second photodetector positioned outside of the mailbox disables the first signal when the outside ambient light is below a given intensity, and a switching means associated with the manually operable flag disables the first signal to distinguish between incoming and outgoing mail.

3 Claims, 1 Drawing Sheet

REMOTE MAIL INDICATOR SYSTEM

Figure 1:
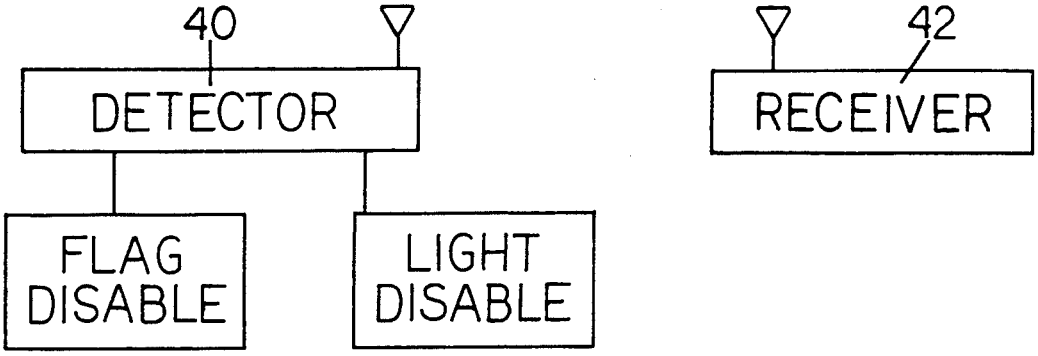

The invention relates to a system for indicating at a remote location the presence or absence of incoming mail in a mailbox, and more particularly to such a system wherein outgoing mail is ignored.

Numerous systems have been suggested for indicating when mail has been delivered to a mailbox, such that the owner need not walk out to the mailbox and open it to see if mail has been delivered. These typically do not discriminate between incoming and outgoing mail, or require some special manipulation or mode of operation by the owner in order to so discriminate.

One such prior art device is U.S. Pat. No. 4,794,377 to Benages, wherein the owner must remember to push a special button mounted within the mailbox when outgoing mail is placed in the mailbox, in order to avoid a false indication of incoming mail. In addition, the apparatus of Benages intrudes within the space of the mailbox, reducing the volume available for mail.

According to the present invention, these and other difficulties of the prior art are avoided by provision of a remote indicating system which is transparent to the user, requiring no special or unusual manipulations in order to discriminate between incoming and outgoing mail.

According to a primary aspect of the invention, there is provided a remote indicator system for determining when incoming mail is present in a mailbox, the mailbox comprising a bottom and further comprising walls defining a top, sides and a closed end, the mailbox further comprising a wall defining an openable door for access to the interior of the mailbox, the system comprising at least one light port for passing a beam of outside ambient light into the mailbox; a first photodetector located in the bottom for normally receiving the beam; mail detector means comprising the first photodetector for normally producing a first signal when the beam impinges on the first photodetector and for normally producing a second signal when the beam is blocked by mail placed within the mailbox; and second photodetector means for disabling the mail detector means from responding to the second signal when the outside ambient light falls below a given intensity.

According to another aspect of the invention, the mail detector means comprises a UHF radio transmitter associated with the mailbox and a UHF radio receiver located remotely from the mailbox, the transmitter producing and transmitting repeatedly a pulsed signal to the receiver in response to the first signal and ceasing to transmit the pulsed signal in response to the second signal.

According to another aspect of the invention, the mailbox further comprises a manually operable flag, and the system further comprises switching means associated with the manually operable flag and disabling the mail detector means from responding to the second signal when the flag is raised.

Figure 2:
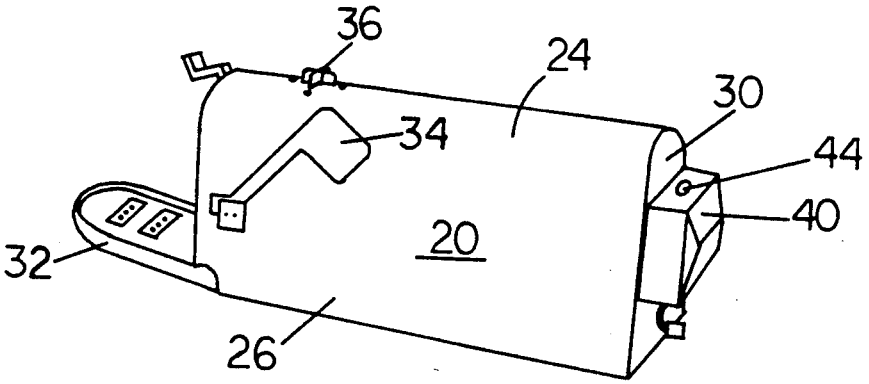
Figure 3:
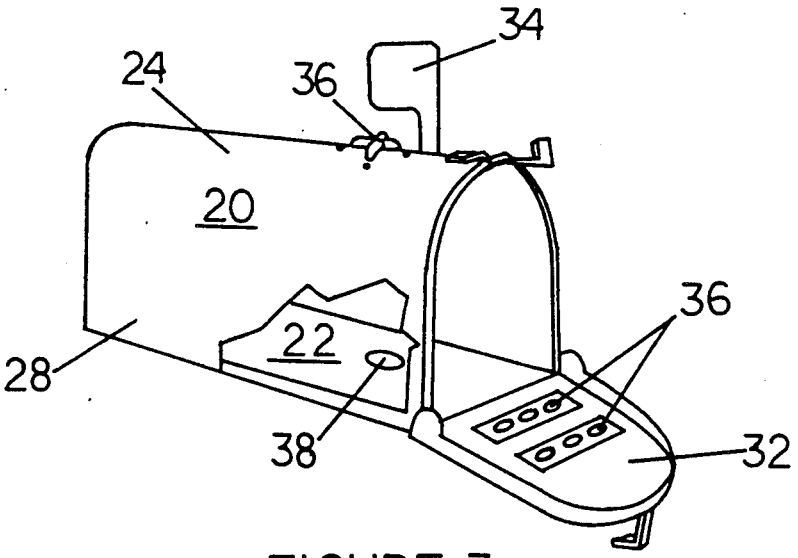

Other aspects will in part be disclosed hereinafter and will in part be apparent from the following detailed disclosure taken together with the accompanying drawing, wherein:

FIG. 1 is a block diagram illustrating the cooperation among the various elements of the system;

FIG. 2 is an isometric view from the right rear quarter of the preferred mailbox according to the invention, showing the conventional flag for indicating when raised to the mail carrier that outgoing mail is present in the box; and FIG. 3 is an isometric view from the left front quarter, partly broken away, of the preferred mailbox according to the invention, having the outgoing mail flag in the raised position.

As illustrated in FIGS. 1-3, the remote indicator system according to the invention is disclosed as applied to mailbox 20, which preferably is of the standard type used for roadside mail delivery. Mailbox 20 comprises bottom 22 and further comprises walls defining top 24, sides 26 and 28, and closed end 30. Mailbox 20 further comprises a wall defining the conventional openable door 32 for access to the interior of mailbox 20, and preferably is equipped with the customary flag 34 which, when raised, informs the mail carrier that outgoing mail is present in mailbox 20. The mailbox as thus far described in this paragraph is conventional.

According to the invention, and with particular reference to FIGS. 2 and 3, the remote indicator system further comprises at least one light port 36, and preferably, as illustrated, a plurality of light ports 36, in one or more of walls 24, 26, 28 and 32 for passing one or more beams of outside ambient light into mailbox 20. Light ports 36 may be simple transparent or translucent members inserted into suitable apertures in the various walls, or may optionally be so formed as to refract or reflect the ambient light outside mailbox 20 into the interior of mailbox 20.

First photodetector 38 is located in bottom 22, and preferably is recessed so as have an upper surface flush with the upper surface of bottom 22, so as to normally receive or be impinged on by the beam or beams of light transmitted to the interior of mailbox 20 through port 36.

First photodetector 38 produces a first signal when the beam of light impinges on photodetector 38, and produces a second signal when the beam of light is blocked by mail placed within mailbox 20.

Detector means 40 normally responds to the presence of the second signal (no light impinging on first photodetector 38, meaning that mail is present) by not transmitting to remote receiver 42, and responds to presence of the first signal (light impinging on first photodetector 38) by transmitting to remote receiver 42, signalling that mail is not present in mailbox 20.

Preferably, detector means 40 comprises a UHF radio transmitter responding to the presence of the first signal (light impinging on first photodetector 38, or no mail present) by producing and transmitting continually and repeatedly a pulsed signal to UHF receiver 42 located remotely from mailbox 20. For example, mailbox 20 may be located at the roadside alongside the home, while receiver 42 may be located in the home. Receiver 42 responds to continual reception of the pulsed signal by indicating visually, aurally, or both, that incoming mail is not present in the mailbox.

When incoming mail is placed in mailbox 20, the mail blocks the beam of light transmitted through port 36, causing first photodetector 38 to produce a second signal, which indicates that light is not impinging on first photodetector 38.

While normally the presence of the second signal would indicate that mail is present, this would give a false signal after nightfall. Accordingly, second photodetector 44 is mounted outside of mailbox 20 so as to be exposed to the outside ambient light, as by being mounted on detector means 40 attached to closed end 30 at the rear of mailbox 20. When the outside ambient light decreases below a given intensity, the changed output of second photodetector 44 disables detector means 40 from responding to the second signal being produced by first photodetector 38, thus avoiding production of a false indication that mail is present after nightfall. Under these circumstances, mail detector means 40 continues to transmit to receiver 42 the continual or repeated pulsed signal indicating that no mail is present in mailbox 20.

In order to prevent a false indication of incoming mail when outgoing mail is present, and thus blocking the beam of light from reaching and impinging on first photodetector 38, second switching means are provided for disabling detector means 40 from responding to the second signal from first detector means when flag 34 is raised. This may be accomplished by mounting or otherwise operatively associating a mercury switch or the like with flag 34, such that detector means 40 is disabled from responding to the second signal produced by first photodetector 38. Accordingly, detector means continues to transmit the pulsed signal so long as flag 34 is raised, avoiding producing a false indication to receiver 42 that incoming mail is present in mailbox 20.

I claim:

1. A remote indicator system for determining when incoming mail is present in a mailbox, said mailbox comprising a bottom and further comprising walls defining a top, sides, and a closed end, said mailbox further comprising a wall defining an openable door for access to the interior of said mailbox, said system comprising:

(a) at least one light port in one of said walls for passing a beam of outside ambient light into said mailbox;

(b) a first photodetector located in said bottom for normally receiving said beam;

(c) mail detector means comprising said first photodetector for normally producing a first signal when said beam impinges on said first photodetector and for normally producing a second signal when said beam is blocked by mail placed within said mailbox; and (d) second photodetector means for disabling said mail detector means from responding to said second signal when said outside ambient light falls below a given intensity.

2. The remote indicator system defined in claim 1, wherein said mail detector means comprises a UHF radio transmitter associated with said mailbox and a UHF radio receiver located remotely from said mailbox, said transmitter producing and transmitting repeatedly a pulsed signal to said receiver in response to said first signal and ceasing to transmit said pulsed signal in response to said second signal.

3. The remote indicator system defined in claim 2, wherein said mailbox further comprises a manually operable flag, said system further comprising switching means associated with said manually operable flag, said switching means disabling said mail detector means from responding to said second signal when said flag is raised.

* * * * *